United States Patent [19]

Brown

[11] 4,122,420

[45] Oct. 24, 1978

[54] PERMISSIVE-MAKE ELECTROMAGNETIC SWITCH

[75] Inventor: Jack M. Brown, Costa Mesa, Calif.

[73] Assignee: Esterline Electronics Corporation, Costa Mesa, Calif.

[21] Appl. No.: 758,933

[22] Filed: Jan. 13, 1977

[51] Int. Cl.[2] ..... H01H 51/22

[52] U.S. Cl. ..... 335/80; 335/137; 335/179

[58] Field of Search ..... 335/78–80, 335/84, 85, 129, 136, 137, 177, 179, 181, 182, 229, 230, 234

[56] References Cited

U.S. PATENT DOCUMENTS

| | | | |
|---|---|---|---|
| 3,102,974 | 9/1963 | Williams, Jr. | 335/229 X |
| 3,109,903 | 11/1963 | Lychyk | 335/137 X |
| 3,317,871 | 5/1967 | Adams | 335/230 |
| 3,800,252 | 3/1974 | Aigner | 335/129 X |
| 4,064,471 | 12/1977 | Schuessler et al. | 335/229 |

*Primary Examiner*—George Harris
*Attorney, Agent, or Firm*—Harvey C. Nienow

[57] ABSTRACT

A permissive make double throw electromagnetic switch having maximum efficiency in utilizing electrical energy supplied thereto, though being extremely small and compact for use on printed circuit boards. The means for moving the contact actuator comprises a pivotal armature which carries a permanent magnet and a pole piece whereby the permanent magnet causes the pole piece to be drawn into engagement with the core of an electromagnetic winding to thereby move the armature to a retracted position. Energization of the winding causes the armature to be drawn into attracted position in engagement with the core, the flux path through the armature being directly through the core and other flux-conducting means.

7 Claims, 7 Drawing Figures

FIG. 1
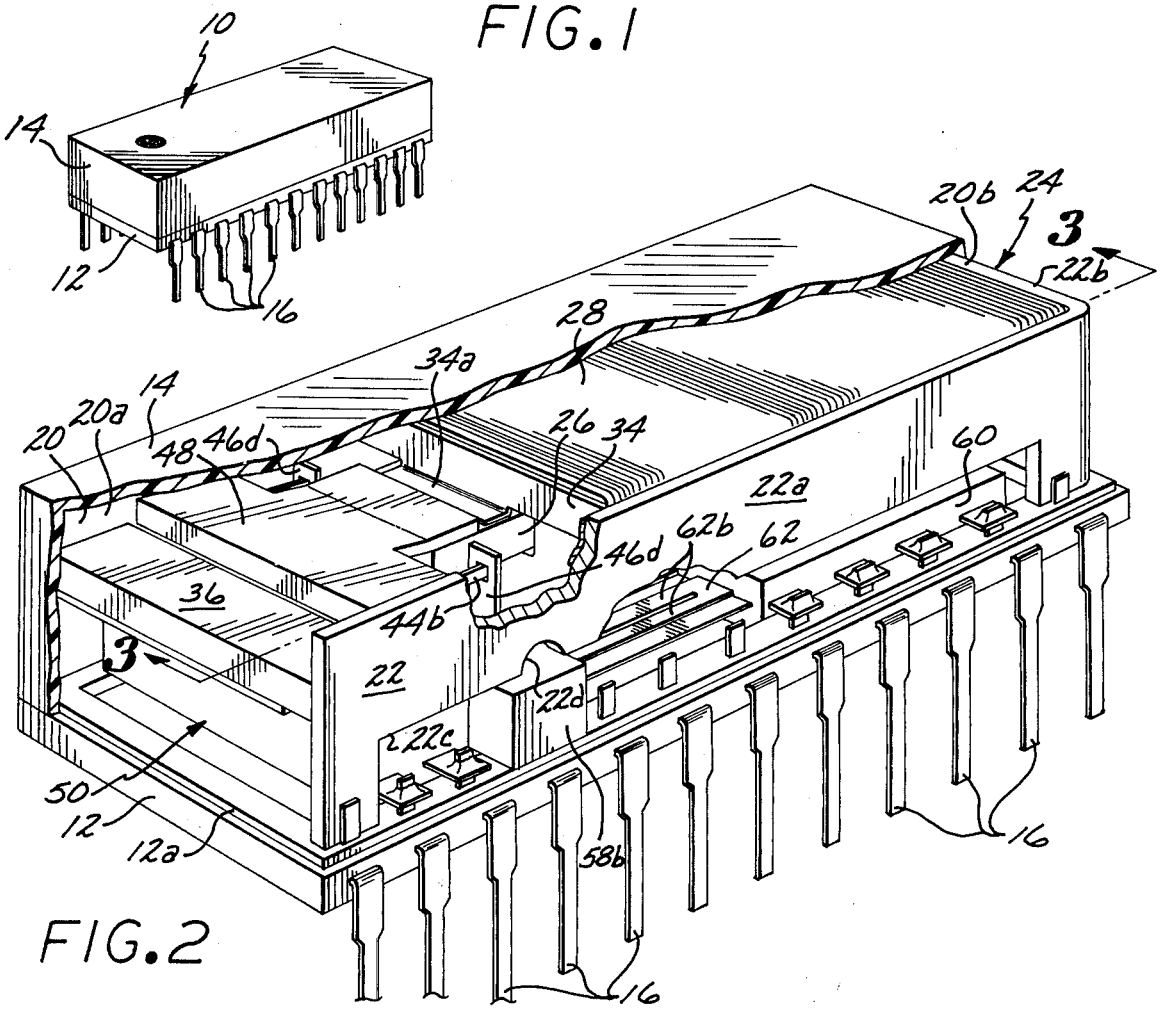
FIG. 2
FIG. 3
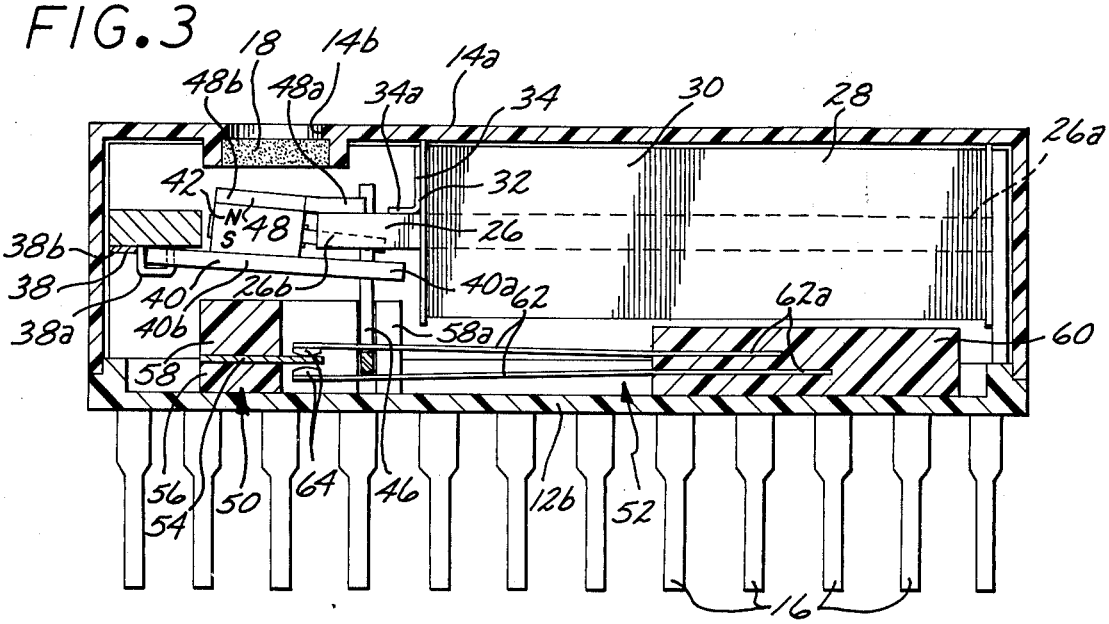

FIG. 4
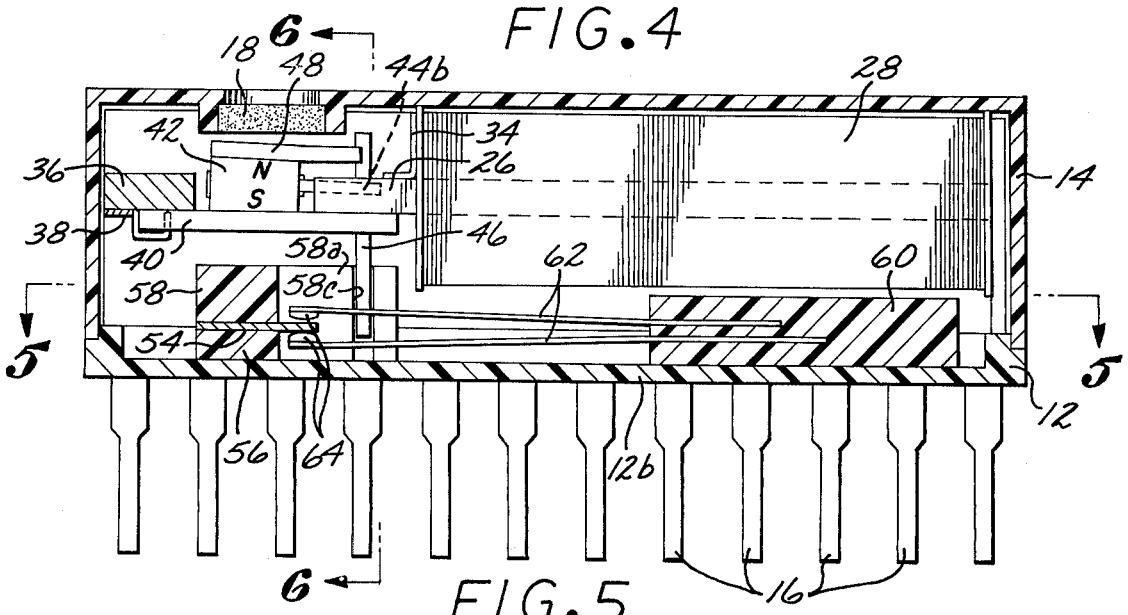
FIG. 5
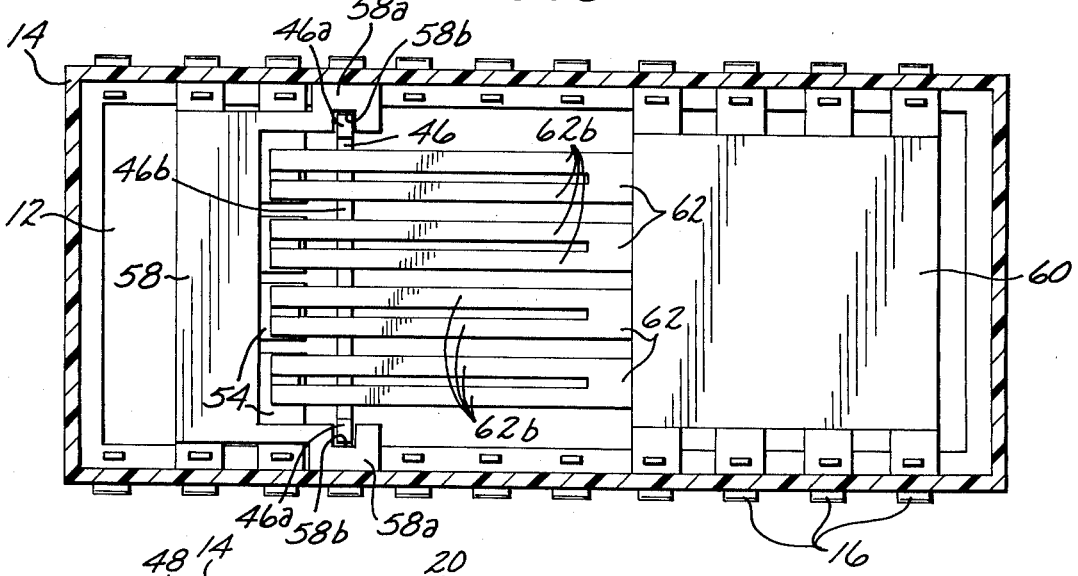
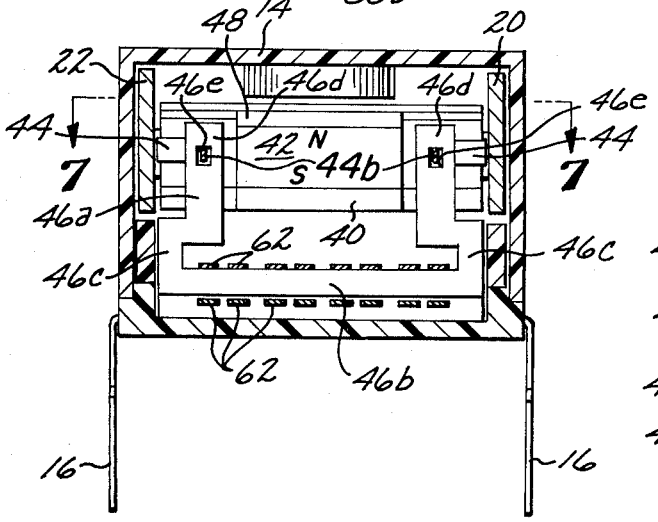
FIG. 6
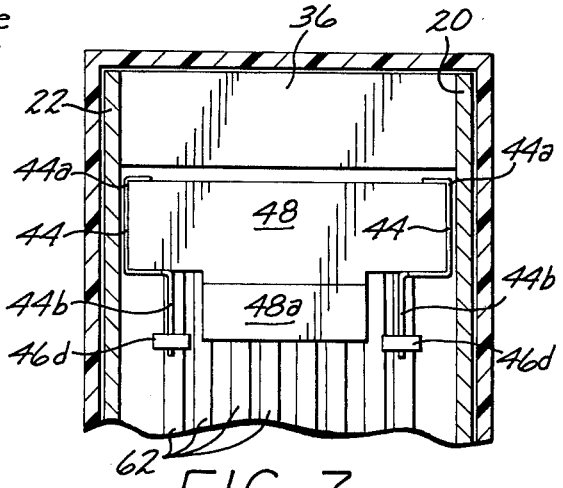
FIG. 7

PERMISSIVE-MAKE ELECTROMAGNETIC SWITCH

The present invention relates generally to permissive-make electromagnetic switches, but more particularly to such switches which have exceptionally efficient operating mechanisms.

The age of miniaturization has greatly influenced the electrical and electronic arts for several decades. Today many complex electronic devices and apparatuses are possible as a result of the advent of printed circuit boards and miniaturized components for use therewith.

Heretofore, there has been a limit as to how small an electromagnetic relay or switch could be made in view of the need for causing electrical contacts to open or close in response to the presence or absence of an extremely small quantity of electrical energy. As a result, for some period of time, electromagnetic relays or switches which were used in conjunction with printed circuit boards were relatively large and cumbersome. The present invention, on the other hand, enables the electromagnetic switch or relay to be constructed within extremely small volumetric dimensions primarily due to the high degree of efficiency in utilizing a small amount of energy to move the electrical contacts.

Accordingly, it is an object of the present invention to provide a permissive-make electromagnetic switch which has a small, compact and efficient electromagnetic motor for converting electrical energy into physical movement.

It is another object of the present invention to provide a permissive-make electromagnetic switch as characterized above wherein the contacts are constantly biased to circuit-completing engagement and are moved to open circuit condition against such bias by the electromagnetic motor.

A still further object of the present invention is to provide a permissive-make electromagnetic switch as characterized above which employs a permanent magnet as an assist in actuating the switch in the direction opposite to that afforded by the electromagnetic motor.

An even further object of the present invention is to provide a permissive-make electromagnetic switch as characterized above which may be of the two-pole, four-pole or six-pole configuration, as desired, and may be of the latch or non-latch variety.

Another further object of the present invention is to provide a permissive-make electromagnetic switch as characterized above which has at least one stationary contact and a movable contact on either side thereof, each of said movable contacts being biased toward engagement with said stationary contact.

A still further object of the present invention is to provide a permissive-make electromagnetic switch as characterized above which is simple and inexpensive to manufacture and which is rugged and dependable in operation.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

FIG. 1 is a perspective view of the exterior of a switch according to the present invention;

FIG. 2 is a fragmentary perspective view of the switch of FIG. 1;

FIG. 3 is a longitudinal sectional view taken substantially along line 3—3 of FIG. 2 of the drawings;

FIG. 4 is a longitudinal sectional view showing the armature in its attracted position;

FIG. 5 is a longitudinal sectional view taken substantially along line 5—5 of FIG. 4;

FIG. 6 is a transverse sectional view taken substantially along line 6—6 of FIG. 4; and FIG. 7 is a fragmentary sectional view taken substantially along line 7—7 of FIG. 6.

Like reference characters indicate corresponding parts throughout the several views of the drawings.

Referring to FIG. 1 of the drawings, there is shown therein an electromagnetic switch 10 having a base 12 and cover 14 therefor. Each of these members is formed of appropriate plastic material and, as shown most clearly in FIGS. 2 and 3 of the drawings, the base 12 is formed with a peripheral shoulder **12*a* for firmly receiving the cover 14. The base 12 is molded with terminal leads 16 as shown in depending position. The entire electromagnetic switch 10 is thereby adapted to be mounted flush on a printed circuit board, the terminals 16** extending through appropriate openings in the board to facilitate dip soldering or other mass production processing for firmly securing such terminals to the board.

As shown most particularly in FIGS. 1, 3, 4 and 6, the top wall **14*a* of cover 14 is formed with a through opening 14*b* wherein a filter 18 formed of sintered metal is provided to permit the interior of the electromagnetic switch 10** to breathe while preventing the ingress of foreign and deleterious materials.

A pair of magnetically permeable L-shaped flux-conducting members 20 and 22 are welded together to provide the generally U-shaped magnetic structure 24 shown most clearly in FIG. 2 of the drawings. Each such member 20 and 22 is formed with a side portion, as shown at **20*a* and 22*a*, and an end portion, as shown at 20*b* and 22*b*. The shorter end portions are welded together to form the U-shaped magnetic structure 24** as shown.

To afford access to certain of the internal components of switch 10, each of the side portions **20*a* and 22*a* is formed with an elongated cutout, as shown at 22*c* with respect to member 22, and a semi-circular cutout as shown at 22*d***.

A magnetic core 26 is provided, having an end portion **26*a* which is welded to the members 20*b* and 22*b*** when the latter are welded together as above described. Such core is formed of magnetically permeable material and is generally rectangular in cross section.

To provide the electromagnetic motor for switch 10, a winding 28 having a plurality of convolutions of wire 30 wound on a plastic or cardboard bobbin 32 is slideably mounted on the core 26, as shown. Such winding 28 is preferably formed so as to have a generally rectangular cross section as also shown. An end plate 34, conforming to the shape of the end of the winding 28, is provided to hold the winding 28 in its assembled position on core 26. A tab **34*a* is stamped in end plate 34, and is firmly secured, as by welding, soldering, brazing or the like, to the end 26*b* of core 26** to retain the core in a fixed position.

A magnetically permeable bar 36 is secured to the flux-conducting members 20 and 22, between the ends of the side portions **20*a* and 22*a*. Such bar is generally rectangular in cross section and conducts magnetic flux from the members 20 and 22**.

Secured to the undersurface of bar 36 is a hinge member 38 having a generally U-shaped portion 38*a* and a mounting portion 38*b*.

An armature 40 is pivotally mounted on the hinge or bracket 38 and is provided with a reduced end portion 40*a* which is movable into and out of engagement with the undersurface of the end portion 26*b* of core 26, as will be hereinafter described in greater detail.

A permanent magnet 42 is secured to the upper surface of the main body 40*b* of armature 40 by any appropriate means. As shown most clearly in FIGS. 6 and 7 of the drawings, a bracket 44 is provided around each of the opposite ends of the permanent magnet 42. Each such bracket has a generally U-shaped mounting portion 44*a* which partially encircles the respective end of the permanent magnet and an arm or extension 44*b* which engages a contactor 46 as will be hereinafter described in greater detail.

Fixed to the upper surface of permanent magnet 42 is a pole piece 48 having a reduced end portion 48*a* for engagement with the upper surface of the end 26*b* of core 26. The main portion 48*b* of pole piece 48 is secured to the magnet by any appropriate means.

Mounted on the bottom wall 12*b* of the base 12 are appropriate circuit controlling elements, including a stationary contact structure 50 and a movable contact structure 52. The stationary contact structure comprises one or more stationary contacts 54 secured between a lower mounting member 56 and an upper mounting member 58.

As shown most particularly in FIG. 5 of the drawings, the upper member 58 is generally rectangular in construction and has a pair of oppositely disposed guide members 58*a*. Each such guide member is provided with a U-shaped slot, as shown at 58*b* to provide means for guiding the rectilinear movement of contactor 46 as will be hereinafter described in greater detail.

The upper and lower mounting members 58 and 56 are firmly secured together with the stationary contact means 54 therebetween, to thereby provide a unitary structure. The latter is then firmly secured to the bottom wall 12*b* of the base 12 in any appropriate manner.

The movable contact structure 52 comprises a mounting block 60 wherein a plurality of flexible contact arms 62 are partially embedded as shown at 62*a*. Each such contact arm carries a movable contact, as shown at 64.

As will be readily understood by those persons skilled in the art, the stationary contact 54 may comprise one or more such stationary contacts, either formed contiguously and therefore electrically connected together, or it may be formed with a plurality of individual stationary contacts which are electrically separate and independent of each other. In like manner, a single movable contact can be provided for each stationary contact or two oppositely disposed movable contacts may be provided, as shown in FIGS. 3 and 4 of the drawings. As shown in FIG. 5, and essential for some applications, two upper contacts and two lower contacts are provided for each contact arm, the latter of which are bifurcated to provide contact arm sections 62*b*, each of which carries a movable contact 64.

This arrangement provides a safety factor in insuring that the respective electrical circuits are, in fact, completed upon proper actuation of the electromagnetic switch. That is, with two contacts in each electrical circuit, the probability of circuit closure is increased considerably.

The contactor 46 is generally U-shape in construction, having a pair of oppositely disposed upstanding arms 46*a* and an intermediate actuator 46*b*. As shown most clearly in FIG. 6 of the drawings, each of the upstanding arms 46*a* is formed with a bearing portion 46*c* which slides in the respective U-shaped cutout 58*b*, and an arm 46*d* formed with a through opening 46*e*.

As shown most clearly in FIGS. 1, 3, 4 and 6, the arms 44*b* of the brackets 44 are caused to extend through the openings 46*e* in the respective arms 46*d* so that as the armature structure pivots on the bracket 38, the contactor 46 is caused to move up or down, as the case may be. As shown in FIG. 6, the upper and lower movable contact members are positioned on opposite sides of the actuator 46*b* of contactor 46. Thus, as the contactor 46 moves, the appropriate contacts are caused to move accordingly.

The flexible material of the arms 62 causes the sections 62*b* to provide the bias for moving the respective stationary contacts 64 into engagement with the corresponding stationary contact 54. That is, without interference from the contactor 46, such bias causes the movable contacts to be moved into circuit making position. However, with the actuator 46*b* between the upper and lower movable contacts, as the contactor 46 moves upwardly, the upper movable contacts are moved to circuit open position against the force of the respective biasing arms 62. Such action permits the inherent bias in the contact arms of the lowermost movable contacts to move the respective contacts into engagement with the corresponding stationary contacts. In reverse fashion, when the contactor is moved downwardly, the lowermost movable contacts are moved out of engagement with the stationary contacts and thereby the uppermost movable contacts are permitted to move into engagement with the stationary contacts under the force of their particular biasing arms 62.

FIG. 3 of the drawings shows the electromagnetic motor in its de-energized position with the contactor 46 in its lowermost position such that the lowermost movable contacts 64 are out of engagement with the respective stationary contacts. At this time, the flux afforded by the permanent magnet 42 flows through the pole piece 48, core member 26, flux-conducting members 20 and 22, bar 36, hinge 38 and armature 40. This retains the pole piece end portion 48*a* in engagement with the upper surface of the end 26*b* of core 26.

Upon energization of winding 28, the electromagnetic flux therefrom causes armature 40 to pivot about the mounting bracket 38 to thereby cause the end portion 48*a* to engage the undersurface of end portion 26*b* of core 26. At the same time, pole piece 48 is moved out of engagement with core 26.

Such electromagnetic flux flows through core 26, flux-conducting members 20 and 22, bar 36, bracket 38 and armature 40 to retain the contactor 46 in its uppermost position. When is such position, the upper movable contacts 64 are held out of engagement with the stationary contacts and the lower movable contacts are permitted to move into engagement with such stationary contacts under the influence of their biasing arms 62.

The terminals 16 are connected in circuit with the appropriate components, such as winding 28 and the various stationary and movable contacts so that connection of such terminals to a printed circuit board effectively connects such components to the appropriate circuits.

It is thus seen that the present invention provides an efficient electromagnetic motor for use in a permissive-make type of switch, to enable an extremely small, compact and efficient structure to be provided for use on printed circuit boards.

Although I have shown and described certain specific embodiments of my invention, I am well aware that many modifications thereof are possible. The invention is not to be restricted except insofar as is necessitated by the prior art and by the spirit of the appended claims.

I claim:

1. A permissive-make double throw electromagnetic switch comprising in combination, at least one stationary contact and a pair of movable contacts on opposite sides thereof individually biased toward engagement with said stationary contact, an actuator operatively interposed between said movable contacts to alternatively move said movable contacts to disengagement with said stationary contacts against the respective bias, an electromagnetic assembly comprising a winding and flux-conducting means associated therewith, an armature operatively connected to said actuator and having a first portion pivotally mounted on one end of said flux-conducting means and a second portion movable from retracted to attracted position on one side of the other end of said flux-conducting means upon energization of said winding, and auxilliary magnet means on said armature having a pole piece on the side of said flux-conducting means opposite said one side to move said armature to retracted position upon de-energization of said winding.

2. A permissive-make double throw electromagnetic switch according to claim 1, wherein said auxilliary magnet means comprises a permanent magnet affording flux-flow through said flux-conducting means in the direction opposite to the flux-flow afforded therethrough by energization of said winding.

3. A permissive-make double throw electromagnetic switch according to claim 2, wherein pivotal mounting means is interposed between said first portion of said armature and said flux-conducting means and the flux from both said permanent magnet and said winding are caused to flow through said mounting means.

4. A permissive-make double throw electromagnetic switch according to claim 3, wherein said permanent magnet is interposed between said armature and said pole piece, said armature and pole piece being disposed on opposite sides of said one end of said flux-conducting means to afford opposite movement of said actuator.

5. A permissive-make double throw electromagnetic switch according to claim 4, wherein said flux-conducting means comprises a core in said winding, one end of said core constituting said one end of said flux-conducting means.

6. A permissive-make double throw electromagnetic switch according to claim 5, wherein said electromagnetic assembly and said armature, permanent magnet and pole piece are contiguously arranged to provide a thin electromagnetic motor for operating said contacts.

7. A permissive-make double throw electromagnetic switch according to claim 6, wherein the flux generated by energization of said winding flows from said core through only said flux-conducting means, said pivotal mounting means and said armature for maximum efficiency of the energy to said winding.

* * * * *